US005759353A

United States Patent [19]

Jaakkola et al.

[11] Patent Number: 5,759,353

[45] Date of Patent: Jun. 2, 1998

[54] WEB FORMER IN A PAPER MACHINE

[75] Inventors: Jyrki Jaakkola, Dollard des Ormeaux, Canada; Michael Odell, Jyväskylä, Finland

[73] Assignee: Valmet Corporation, Helsinki, Finland

[21] Appl. No.: 702,784

[22] Filed: Aug. 23, 1996

[30] Foreign Application Priority Data

Aug. 24, 1995 [FI] Finland ..... 953984

[51] Int. Cl.[6] ..... D21F 1/00

[52] U.S. Cl. ..... 162/301; 162/300; 162/352

[58] Field of Search ..... 162/300, 301, 162/352

[56] References Cited

U.S. PATENT DOCUMENTS

| | | | |
|---|---|---|---|
| 2,881,676 | 4/1959 | Thomas | 162/301 |
| 3,027,940 | 4/1962 | Dunlap | 162/352 |
| 4,917,766 | 4/1990 | Koivuranta et al. | 162/301 |
| 5,045,153 | 9/1991 | Sollinger et al. | 162/301 |
| 5,167,770 | 12/1992 | Bubik et al. | 162/301 |
| 5,211,814 | 5/1993 | Jaakkola et al. | 162/301 |
| 5,389,206 | 2/1995 | Buck et al. | 162/301 |
| 5,552,021 | 9/1996 | Ilvespaa et al. | 162/203 |

FOREIGN PATENT DOCUMENTS

| | | |
|---|---|---|
| 87588 | 10/1992 | Finland . |
| 930927 | 3/1993 | Finland . |
| 91091 | 4/1993 | Finland . |
| 932264 | 5/1993 | Finland . |
| 932265 | 5/1993 | Finland . |
| 934667 | 10/1993 | Finland . |
| 951862 | 4/1995 | Finland . |
| 934999 | 5/1995 | Finland . |

*Primary Examiner*—Karen M. Hastings
*Attorney, Agent, or Firm*—Steinberg, Raskin & Davidson, P.C.

[57] ABSTRACT

A former section provided with a twin-wire zone in a paper machine including a carrying wire and a covering wire which form the twin-wire zone therebetween them, and web-forming and draining members arranged in the twin-wire zone. In an initial part of the twin-wire zone, a stationary unit of forming ribs is arranged inside a loop of one of the wires and includes transverse forming ribs extending across the entire width of the wires and placed at a distance from one another to define gaps therebetween. A loading unit is placed opposite to these forming ribs inside the loop of the opposite wire and includes spring blades which are loaded against that wire. The dragging and loading areas of these spring blades are placed substantially in the middle areas of the gaps between the forming ribs in the stationary unit of forming ribs to prevent crushing of the web between the forming ribs in the stationary unit of forming ribs.

21 Claims, 7 Drawing Sheets

WEB FORMER IN A PAPER MACHINE

FIELD OF THE INVENTION

The present invention relates to a web former in a paper machine in which a carrying wire and a covering wire define a twin-wire zone therebetween and includes web forming and dewatering members arranged in the twin-wire zone. A fibrous web or layer is supported by the wires during a run through the former and is dewatered by the web forming and dewatering members.

BACKGROUND OF THE INVENTION

In web formers in paper machines, a number of different forming members are used. One of the principal functions of these forming members is to produce pressure pulsation in the fiber layer that is formed, i.e., direct or apply a pressure pulsation thereto. By means of the pressure pulsation, dewatering of the web that is being formed is promoted and, at the same time, its formation is improved. Further, in the prior art, various forming shoes are known, which are usually provided with a curved ribbed deck and over which the forming wires placed one above the other are curved, the web being placed between the wires (or sandwiched therebetween). In this manner, water is drained out of the web substantially through the wire placed at the side of the outside curve by the effect of its tensioning pressure. The curved ribbed deck of the forming shoe produces a pressure pulsation which promotes the dewatering and improves the formation of the web.

Further, in the prior art, various forming rolls, foil ribs, suction boxes, and suction rolls are known, by whose means a difference in pressure and pressure pulsation, which promote the dewatering of the web, are produced in the fiber layer that is being formed.

Attempts are made to construct the headboxes and web formers of paper machines so that it should be possible to produce a paper web whose basis weight, formation and strength properties are homogeneous and/or uniform across substantially the entire width of the web and from which paper, a minimal width at the edges of the web has to be cut off. From paper, in particular from fine paper, increased uniformity of the structure is required, which is required by such recently introduced printing and copying processes in which very rapid and intensive heating of the sheet produced from the paper takes place.

Drawbacks involved in the use of prior art forming members include wire damage which arises from particles of contaminants passing between the glide faces of the forming members and the wires, which particles may produce flattening and/or shifting of the wire fibers with resulting damage to the wire. This drawback is manifested with particular emphasis when both of the wires are placed facing and between two forming members, such as forming ribs, "hard against hard", i.e., the wires and the fiber web placed between them have to pass between the two opposed forming members. In other words, the forming ribs are at least partially in direct opposed relationship to one another and the wires and web must be passed through the space defined between the hard forming ribs.

In the prior art, various so-called MB formers are known, in which there are sets of ribs on opposite sides of the twin-wire zone loaded against one another by means of various pressure media. With respect to the most recent embodiments of MB-formers, reference is made by way of non-limiting example to the current assignee's Finnish Patent Application Nos. 930927, 932264, 932265, 934667, and 934999. Finnish Patent Application Nos. 932264, 932265 and 934999 correspond to U.S. patent application Ser. Nos. 08/246,309, 08/246,176 and 08/439,514, respectively, incorporated by reference herein.

The prior art web forming members are generally complicated and have a heavy construction, and most importantly, cross-direction deflection occurs in them, which drawback is increased to a great extent when the paper machines become wider, i.e., the dimension in the direction transverse to the running direction of the web is lengthened. Profiling of the intensity of the pressure pulsation, produced by the prior art forming members, in the cross direction of the web is usually not possible without costly special arrangements. Also, constantly increasing running speeds of paper machines have resulted in ever increasing requirements on different web forming members.

In the current assignee's Finnish Patent Nos. 87,588 and 91,091 (corresponding to U.S. Pat. No. 5,211,814, incorporated by reference herein), a wire loading device in a paper machine is described by whose means a mechanical load is applied to the wire of the paper machine across its entire width. By means of the mechanical load, a pressure pulse is applied to the fiber layer or web placed on support of a wire, or between a pair of wires if present, by means of which pressure pulse the dewatering of the web is promoted, the formation of the web is improved, and/or the cross-direction profiles of different properties of the web are controlled such as the cross-direction profiles of dewatering, filler distribution, formation, and/or of retention. The loading device in accordance with these Finnish patents, and corresponding U.S. patent, comprises a plate-shaped spring blade having a side arranged as substantially tangential to the inner face of the adjacent wire in order to drag against the inner face of the wire and thereby produce a pressure pulse. The spring blade is preferably attached from outside its dragging area to a frame part of the loading device such that a loading force that curves the spring blade in the machine direction and produces the pressure pulse in the web is produced by the intermediate of the frame part and/or loading devices.

The spring blade is arranged preferably "with the fur" in relation to the run of the wire and the web, i.e., so that the attaching point of the blades to the frame part is upstream of the blade tip with respect to the motion of the fabric(s) and the web, which facilitates the prevention of damage caused by fiber strings and increases the possibilities of resilience of the spring blade. It has been recognized that a loading device provided with the spring blade is suitable for use in the web former in certain different positions and generally, in certain portions of a twin-wire area of a twin-wire web former, but also even in the gap area of a gap former. This prior art loading device permits versatile controls and adjustments of the transverse profiles, wherein, if necessary, closed on-line regulation systems based on measurements of the different profiles can be used.

In the Finnish Patent No. 87,588 and in FIGS. 1 and 2 of the corresponding U.S. Pat. No. 5,211,814, the use of the spring blades concerned is described as being a substitute for web forming ribs loaded by means of pressure-medium hoses in a MB former. In these publications, the dragging areas of the spring blades are, however, generally arranged to directly face the opposite stationary forming ribs, which is the location in which the web forming ribs would have been placed, and not at a location or gap between the ribs, in which the web forming ribs are not positioned since the web forming ribs operate in direct opposition to the stationary forming ribs.

In the prior art rib formers, such as MB formers, the dewatering is usually arranged to take place in two directions, so that water is removed in a horizontal twin-wire zone also in an upward direction against the force of gravity, which consumes a relatively large amount of dewatering energy. Moreover, in view of intensifying the dewatering, negative pressure is employed in the rib units. In test runs carried out, representatives of the current assignee have noticed that, between successive ribs, this negative pressure curves the wire that is placed at the side of lower pressure and at the side of the ribs to a greater extent than it curves the opposite wire, whereby a bag is formed between the wires which deteriorates the web formation and produces a phenomenon known as crushing in the web that is being formed. This drawback is also present in the situation where, in accordance with the last-mentioned Finnish and U.S. patents, loaded spring blades are used directly against the ribs while facing the ribs or placed in the immediate vicinity of the ribs.

In the prior art formers in which there are sets of MB ribs placed alternatingly one opposite to the other in a twin-wire zone, it is a further drawback that the rib loading wears the wires mechanically quite rapidly. Also, the construction of the hose-loaded MB units is quite complicated and thus expensive, partially also because the sets of ribs must be manufactured with high precision. By means of the sets of MB ribs, it is also quite difficult to provide a control of the cross-direction profiles of the web. The prior art sets of MB ribs are wearing parts, which must be replaced frequently, which replacement procedure is quite laborious and produces quite long standstills in the production of paper.

OBJECTS AND SUMMARY OF THE INVENTION

An object of the present invention is further development of the rib formers provided with the spring blade wire loading units so that the drawbacks discussed above are avoided.

Another object of the present invention is to provide novel solutions for the problems discussed above.

It is another object of the present invention to provide a new and improved gap former having a twin-wire forming zone.

It is yet another object of the present invention to provide a new and improved hybrid former having a single-wire initial forming zone and a subsequent twin-wire forming zone.

In view of achieving the objects stated above and others, the present invention includes a stationary unit of forming ribs arranged in the initial part of the twin-wire zone inside one of the wires. In the stationary set of ribs, there are transverse forming ribs which extend across substantially the entire width of the wires, i.e., in a direction transverse to the running direction of the wires, and which are placed at a distance from one another to define gaps or spaces therebetween. The forming ribs engage that wire during operation of the web former. Placed opposite to these forming ribs, inside the loop of the opposite wire, there is a loading unit which comprises spring blades that are loaded against the opposite wire. A dragging and loading area of the spring blades is placed substantially in the middle or center areas of the gaps between the forming ribs, i.e., not in direct opposed relationship to the forming ribs nor in the immediate vicinity thereof.

In accordance with the present invention, when the dragging areas of the loaded spring blades are arranged in the middle areas of the gaps formed between the ribs, the wires can be made to stay together better in the rib gaps, and the phenomenon of crushing discussed above does not and cannot occur. When the invention is applied in practice, even a negative pressure effective in the gaps between the ribs is not necessarily needed, even though the use of such negative pressure is by no means excluded from the scope of the invention.

The scope of application of the present invention includes both gap formers and hybrid formers, but, based on the experiments that have been carried out so far, the most advantageous embodiments of the invention have been found in gap formers in particular in gap formers in which the spring blade wire loading units are placed inside the upperwire loop and operate against a stationary rib unit placed inside the lower-wire loop. In this case, the difficulties of dewatering that takes place in an upward direction against the force of gravity are largely avoided. When spring blade units arranged in accordance with the invention are used, the wear of the wires can be reduced and the wearing parts are mainly the spring blades which can be arranged to be replaceable in a relatively quick manner.

In one particular embodiment of the invention, the twin-wire zone is curved constantly in the same direction, and the dewatering is carried out primarily by the force of gravity and, if necessary, based on the kinetic energy of the water that is drained, whereby a former construction is obtained that is advantageous both in view of the construction and in view of the energy economy.

In the following, the invention will be described in detail with reference to some exemplifying embodiments of the invention illustrated in the accompanying drawing. The invention is by no means strictly confined to the details of the illustrated and described embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
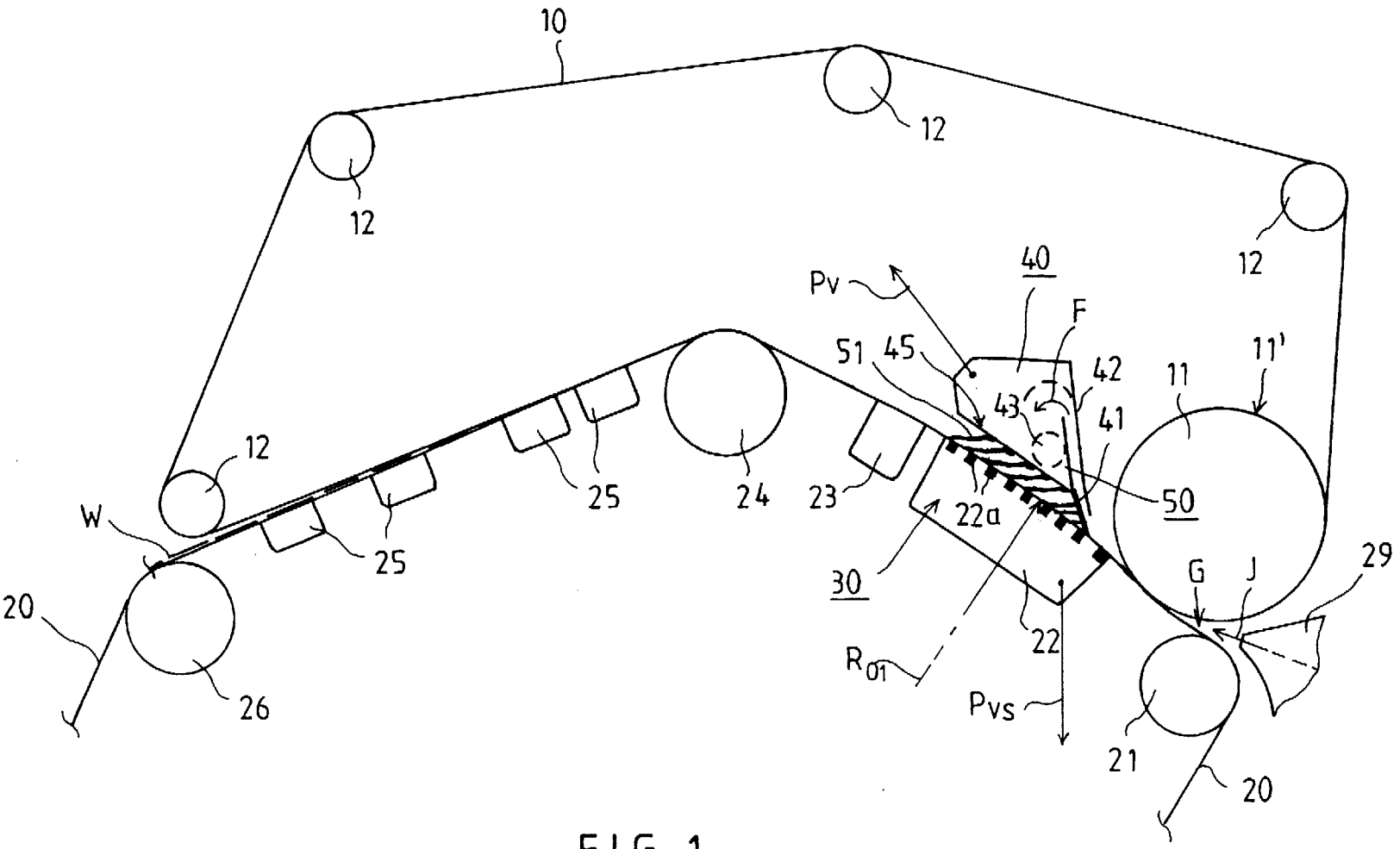
FIG. 1 illustrates one particularly advantageous embodiment of the invention, i.e., a gap former in which the spring blade units are placed above, opposite to the ribs of the curved forming shoe placed underneath.
Figure 2:
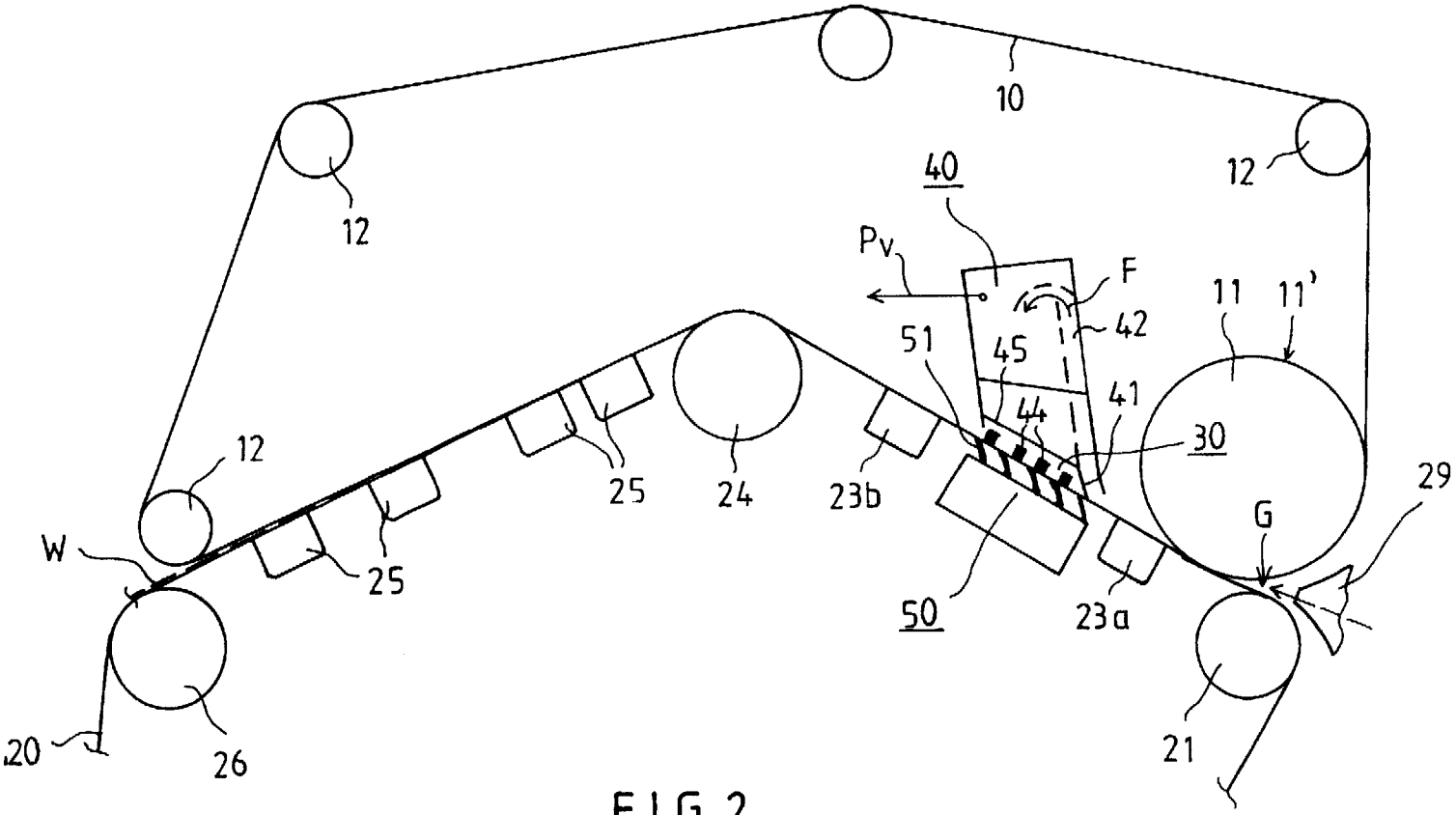
FIG. 2 shows a gap former in which the spring blade units and the forming ribs are placed in the reversed order as compared with FIG. 1.
Figure 3:
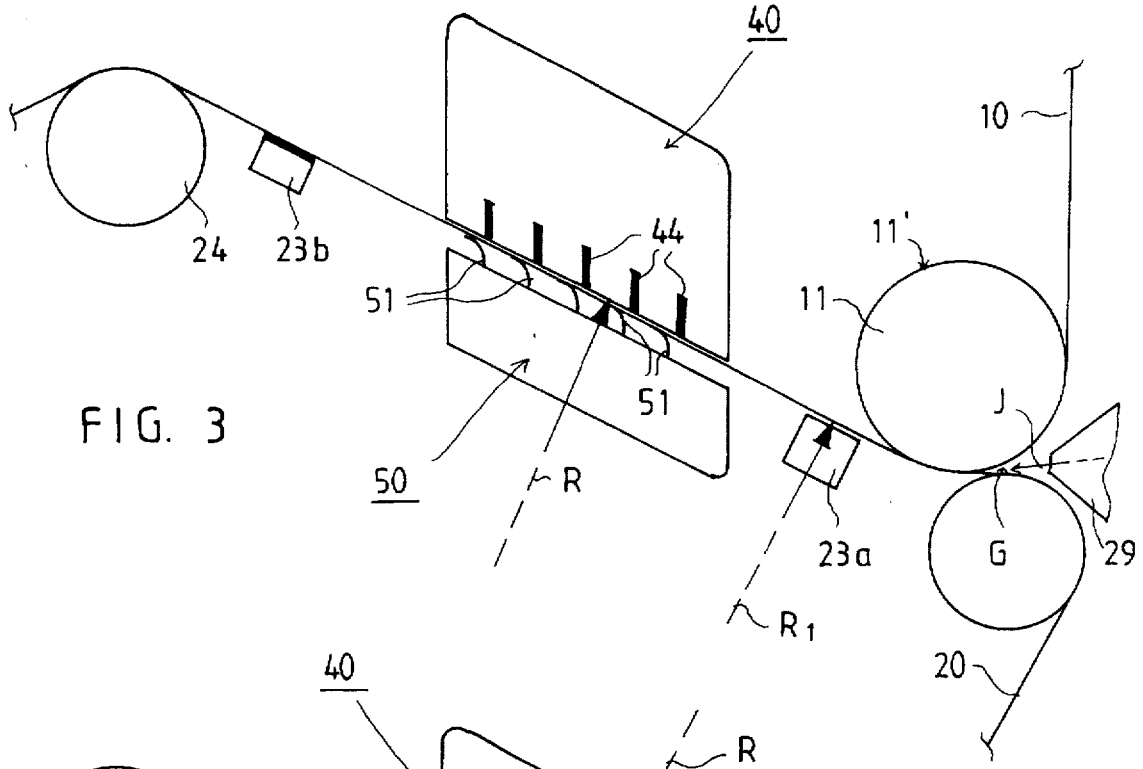
FIG. 3 shows an alternative embodiment of the initial part of the twin-wire zone in a gap former of the type shown in FIGS. 1 and 2.
Figure 4:
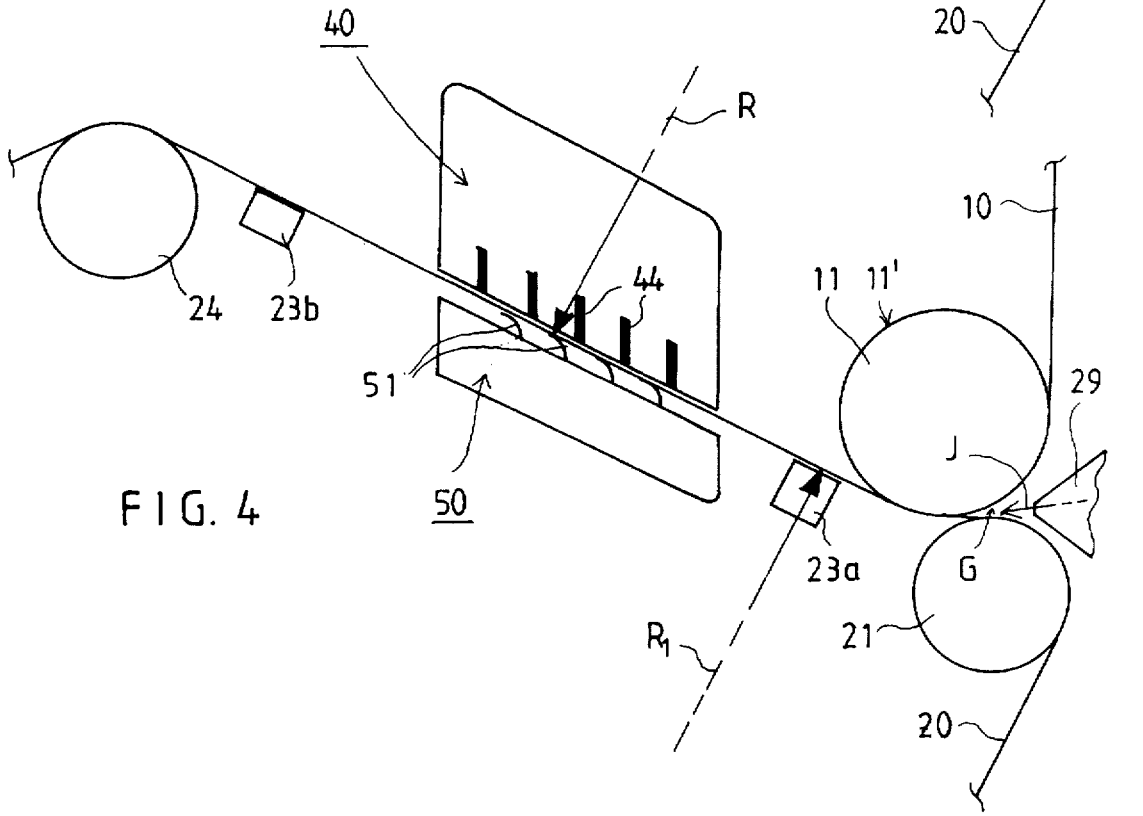
FIG. 4 is an illustration similar to FIG. 3 of a second alternative embodiment of the initial part of the twin-wire zone.

Referring to the accompanying drawings wherein the same reference numerals refer to the same or similar elements, in FIGS. 1–4, a gap former in accordance with the invention is shown, in which a pulp suspension jet J is fed out of the discharge opening of a headbox 29 into a forming gap G defined by a convergence of and between a pair of forming wires 10 and 20. More particularly, the forming gap is defined between a loop of the upper wire 10 in a region as it runs about a forming roll 11 having a hollow-face 11' and a straight run of the lower wire 20 after a breast roll 21. The lower wire 20 may be guided to engage the web W formed from the suspension jet J at a location at which the lower wire 20 will be oriented in a direction tangent to the forming roll 11. After the forming gap G, an upwardly inclined twin-wire zone starts, in which there is a combination in accordance with the invention of a spring blade wire loading unit 50 (also referred to hereinafter as a spring blade unit) and a forming rib unit 30. In FIGS. 2, 3 and 4, at both sides of the combination of units 30,50, inside the loop of the lower wire 20, there are suction boxes 23*a* and 23*b*, and in FIG. 1, after the combination of units 30,50, there is one suction flatbox 23. In FIGS. 3 and 4, the first suction box 23*a* has a lower wire 20 guide deck having a relatively large curve radius $R_1$. After the suction box 23,23*a*, the twin-wire zone is curved downwardly on a forming roll 24, which is followed by two pairs of suction flatboxes 25 arranged inside the loop of the lower wire 20. In the area of the latter one of the pairs of suction flatboxes, the web W is separated from the upper wire 10, which is guided by guide rolls 12, and is transferred, while curved on a suction roll 26, on the lower wire 20 to a pick-up point and from the pick-up point, further on a pick-up fabric into a subsequent press section (not shown).

In FIG. 1, a short straight run of the twin-wire zone is provided after the forming gap G after which the twin-wire zone is guided by the forming shoe 22 arranged inside the lower-wire loop, which forming shoe 22 is provided with a ribbed deck 22*a*. The ribbed deck 22*a* of the forming shoe 22 has a relatively large curve radius $R_{01}$ which is typically in a range of from about 3 m to about 10 m. This curve radius $R_{01}$ is in the same direction as the rest of the curve form in the twin-wire zone. The interior space in the forming shoe 22 may be connected to a vacuum which is effective in the gap spaces in the ribbed deck 22*a* and is schematically illustrated by arrow $P_{VS}$. The forming shoe 20 constitutes part of the forming rib unit 30. Above the forming shoe 22 and inside the loop of the upper wire 10, there is a suction-deflector unit 40 having a deflector rib 41 at a front end closer to the forming gap. In front of the deflector rib 41, an opening of a suction-deflector duct 42 is situated through which water drained through the upper wire 10 is transferred in the direction of the arrow F, mainly aided by kinetic energy and negative pressure $P_v$ if any, into an interior chamber of the unit 40. From the interior chamber of the unit 40, the drained water is directed further to the side of the former through a duct 43. In connection with a bottom part or member 45 of the suction-deflector unit 40, according to the invention, the loading unit 50 is mounted (a more detailed construction and positioning of the spring blades 51 of the loading unit 50 will be described with reference to FIG. 8). At this point, it should already be stated in this connection that the dragging areas A of the spring blades 51 operate in the middle or central areas of the gaps between the ribs 22*a* of the forming shoe 22 and load the inner face of the upper wire 10 substantially across its entire width.

The embodiment shown in FIG. 2 differs from the embodiment show n in FIG. 1 in the respect that the forming ribs 44 and the spring blades 51 in the unit 50 are in the reverse order in relation to one another. In FIG. 2, the suction-deflector unit 40 is arranged inside the loop of the upper wire 10 and is similar to that described above, i.e., fully stationary forming ribs 44 are fixed in connection with the bottom portion 45 of the suction-deflector unit 40, and the spring blades 51 of the loading unit 50, which are placed inside the lowerwire loop 20, operate in the middle areas between the forming ribs 44 and load the inner face of the lower wire 20. In the area of the units 40/50, the direction of the twin-wire zone between the forming ribs 44 and the spring blades 51 is substantially straight. In other respects, the embodiment shown in FIG. 2 is similar to the embodiment shown in FIG. 1.

FIG. 3 shows a variation of the gap former as shown in FIG. 2 in which the twin-wire zone has an upwardly inclined initial portion. In FIG. 3, the suction-deflector unit 40 is arranged inside the upper-wire loop (with the forming ribs 44 coupled thereto), and the loading unit 50 with its spring blades 51 is arranged inside the loop of the lower wire 20, i.e., in the same sequence as in FIG. 2, but in FIG. 3, unlike in FIG. 2, the direction of the twin-wire zone between the forming ribs 44 in the unit 40 and the spring blades 51 is curved with a curve radius R. The center of the curve radius R is placed at the side of the loop of the lower wire 20. In most other respects, the embodiments shown in FIG. 3 is similar to the embodiment shown in FIGS. 1 and 2.

The initial portion of the twin-wire zone of the gap former shown in FIG. 4 is in most other respects similar to that shown in FIG. 3, with the essential difference being that the center of the curve radius R of the twin-wire zone between the forming ribs 44 and the spring blades 51 is at the side of the loop of the upper wire 10. In FIGS. 3 and 4, the curve radius R is selected preferably in the range of from about 3 m to about 10 m. After the second forming roll 24, the twin-wire zone as shown in FIGS. 3 and 4 is, for example, similar to that shown in FIGS. 1 and 2.

Figure 5:
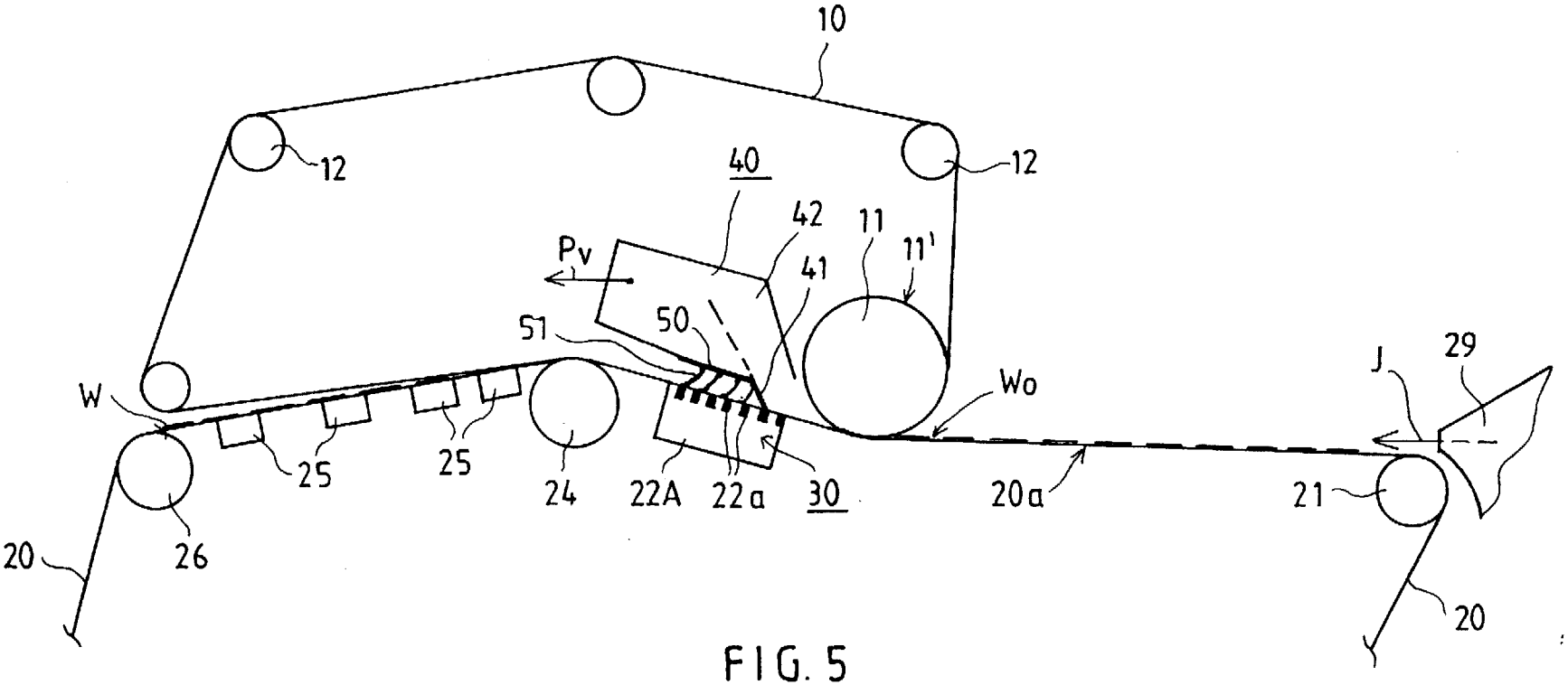
FIG. 5 is a schematic side view of a first embodiment of a hybrid former in accordance with the invention.

FIG. 5 shows a first exemplifying embodiment of a hybrid former in accordance with the invention. In this embodiment, a pulp suspension jet J is fed out of the discharge opening of the headbox 29 onto a horizontal planar portion 20*a* of the lower wire 20. In this manner, the web $W_O$ has time to reach a certain suitable couching degree by the effect of the dewatering elements (not shown) operative in the single-wire portion 20*a* before it is passed into the twin-wire zone, to the upwardly inclined twin-wire zone starting at the rolls 11. In the twin-wire zone, inside the loop of the lower wire 20, there is a forming shoe 22A, which has a ribbed deck 22*a* which may be curved or planar. The suction-deflector and loading units 40 and 50, respectively, placed inside the loop of the upper wire 10 are shown to be similar to those described in FIG. 1. Also in most other respects, the twin-wire zone is substantially similar to that shown in FIG. 1. In the hybrid former as shown in FIG. 5, the twin-wire zone may also be similar to that shown in FIGS. 2, 3 or 4.

It is a feature common to all of the formers shown in FIGS. 1–5 that the initial part of the twin-wire zone is upwardly inclined, and the final part is downwardly inclined, and that the substantial running direction of the twin-wire zone is horizontal.

Figure 6:
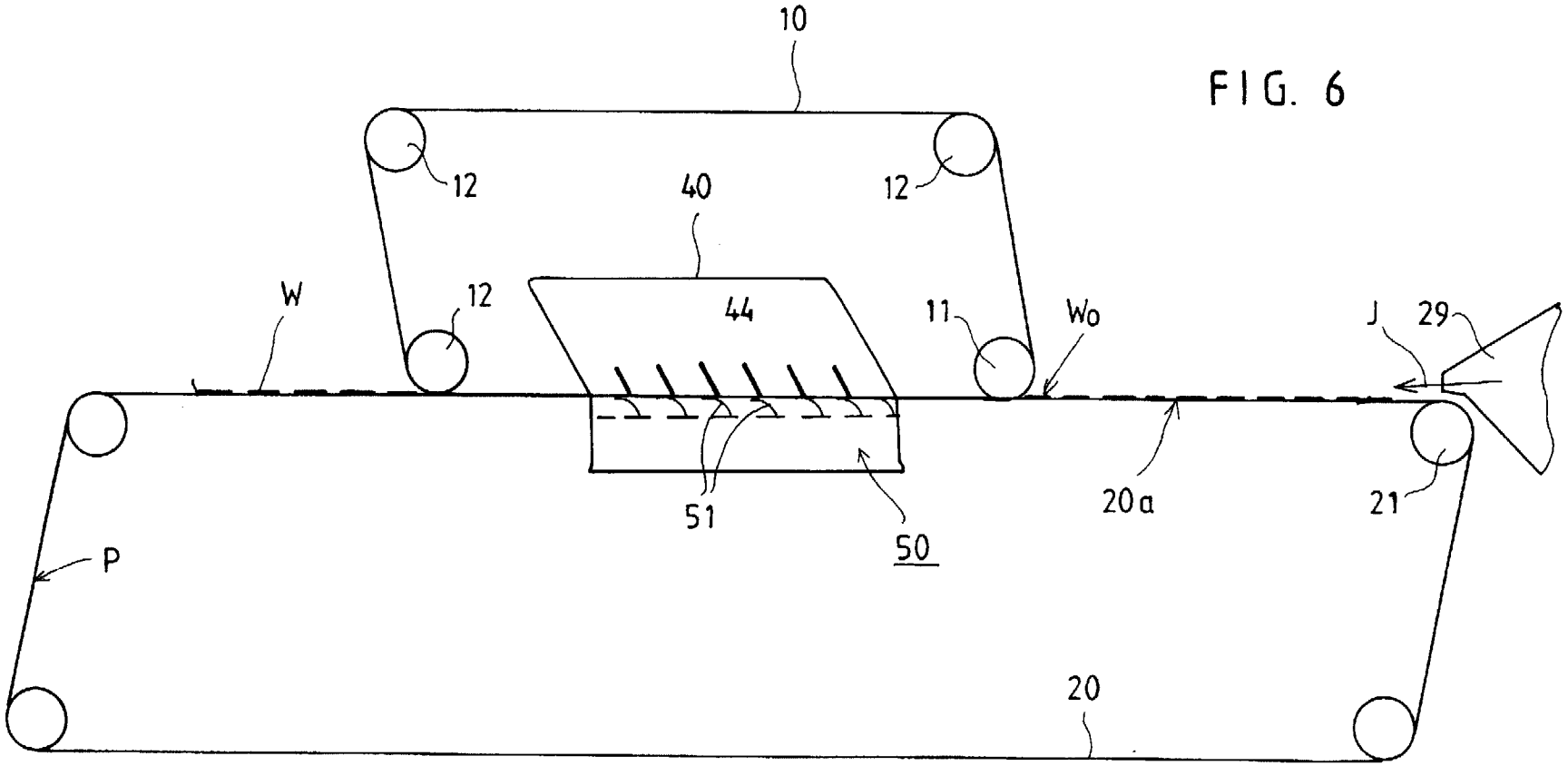
FIG. 6 is a schematic side view of a second embodiment of a hybrid former in accordance with the invention.

FIG. 6 shows a second exemplifying embodiment of a hybrid former in accordance with the invention. In the same manner as in FIG. 5, the pulp suspension jet J is fed out of the slice of the headbox 29 onto the single-wire initial portion 20*a* of the forming zone, which is formed solely by the lower wire 20. After the initial portion 20*a*, the lower face of the paper web $W_O$ which is placed against the lower wire 20, has reached a certain couching degree before it arrives in the twin-wire zone placed between the wires 10 and 20. In FIG. 6, the substantial running direction of the twin-wire zone, which is placed in the portion of the upper wire 10 placed between the guide rolls 11 and 12, is straight. As such, there is no upwardly inclined run at the beginning of the twin-wire zone followed by a downwardly inclined run.

A suction-deflector unit 40 is arranged inside the loop of the upper wire 10 and includes forming ribs 44 similar to those described above. The dragging areas or zones at the tips of the spring blades 51 in the loading unit 50 arranged inside the lower-wire loop 20 are effective at the free gaps between the forming ribs 44. After the twin-wire zone 10,20, the web W follows the lower wire 20 from which it is separated at the pick-up point P and is transferred by means of the pick-up fabric (not shown) to the press section of the paper machine. The hybrid former as shown in FIG. 6 is particularly well suitable for modernization of existing fourdrinier wire parts, so that the lower-wire loop 20 with its frame constructions and possibly-the headbox 29 consist of the existing fourdrinier wire construction, to which in connection with the modernization, the upper-wire unit 10,11,12 and the suction-deflector unit 40 as well as, inside the lower-wire loop, the loading unit 50 are added. The hybrid former as shown in FIG. 5 is also suitable for modernizations of existing fourdrinier wire parts.

Figure 7:
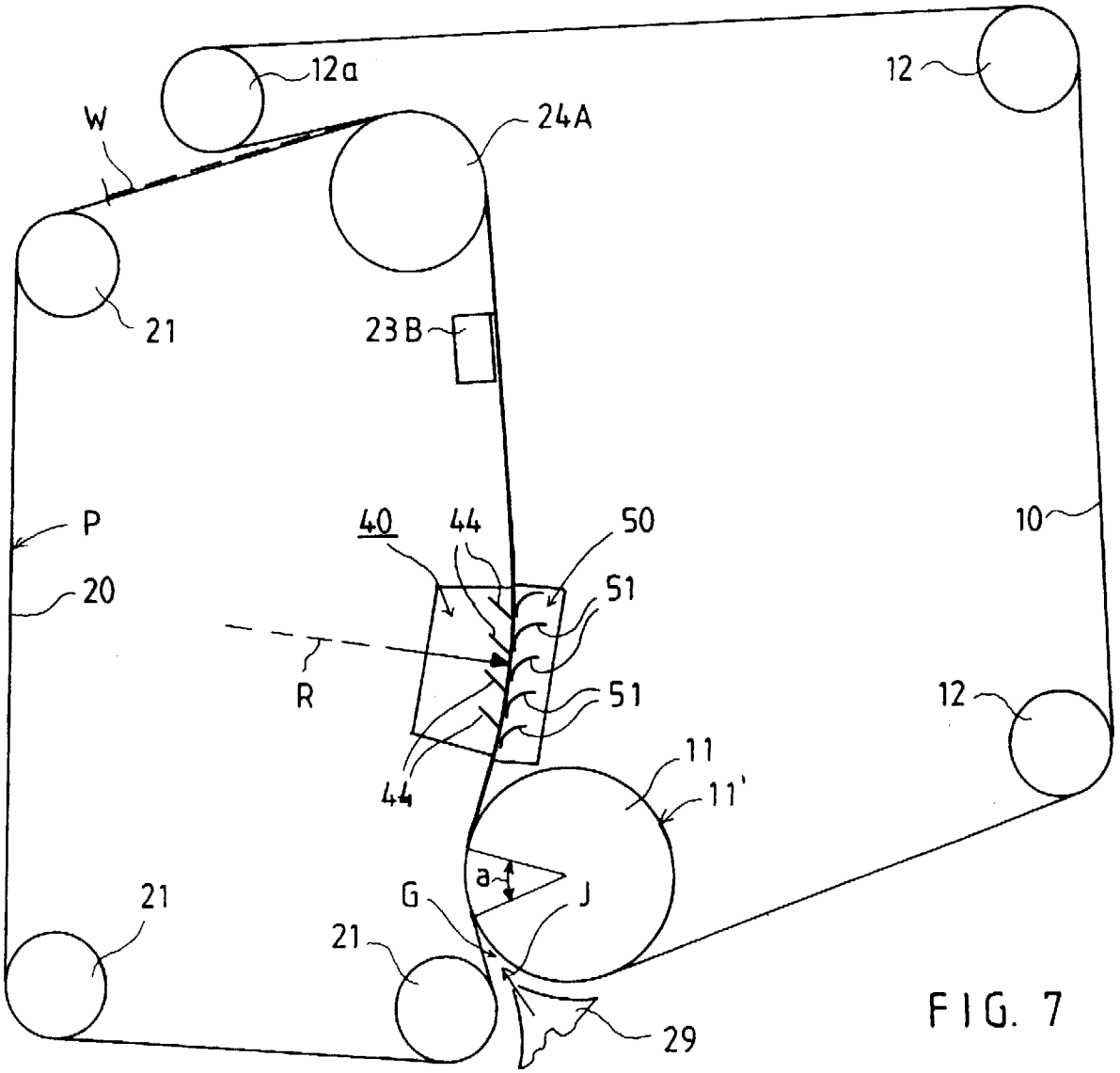
FIG. 7 shows a gap former in accordance with the invention in which the principal direction of the twin-wire zone is vertical and runs vertically upward.

FIG. 7 shows a vertical version of the gap former in accordance with the invention. The run of the twin-wire forming zone is from the bottom toward the top, and its substantial running direction is vertical (vertically upward). The pulp suspension jet J is fed out of the slice of the headbox 29 into the forming gap G. After the forming gap G, the twin-wire zone starts, which zone is curved on the hollow-faced 11' forming roll 11 over the sector a, whose magnitude is typically from about 5° to about 45°. The sector a is followed by a short vertical joint run of the wires 10,20. After this short vertical joint run, a forming zone in accordance with the invention is provided, which comprises a loading unit 50 and a suction-deflector unit 40 and whose curve radius R has its center at the side of the loop of the carrying wire 20. After the sets of ribs 44,51 in the units 40 and 50, respectively, which sets of ribs are placed one opposite to the other alternatingly, there follows a vertical twin-wire zone, in which there is a suction flatbox 23B arranged inside the loop of the carrying wire 20. This is followed by a second forming roll 24A, preferably a suction roll, on which the twin-wire zone is curved over a considerably large angle. Thereafter, the covering wire 10 is separated from the carrying wire 20 and from the web W on the guide roll 12*a*, and the web W follows the carrying wire 20 to the pick-up point P.

Figure 8:
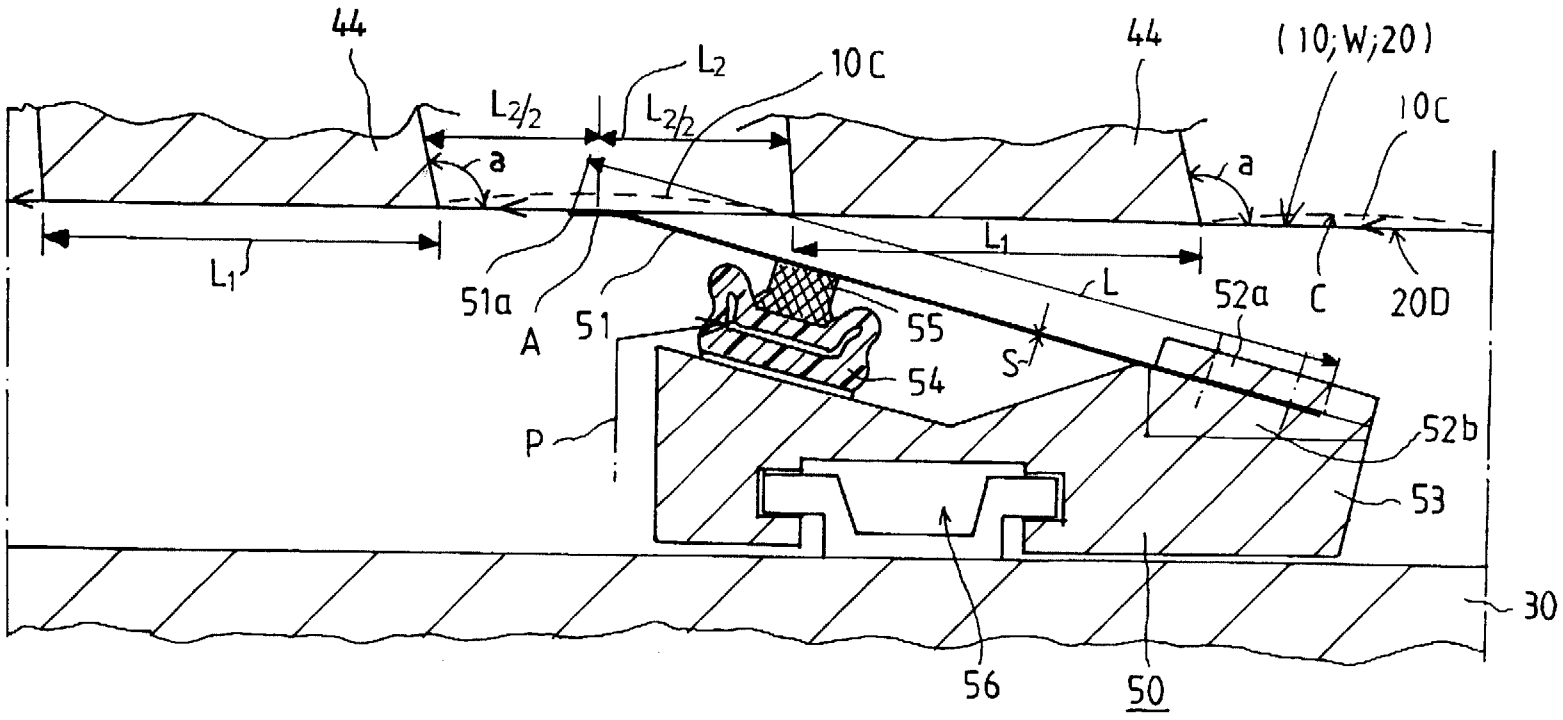
FIG. 8 is a vertical sectional view in the machine direction of a spring blade unit applied in the invention and of its location in a gap between forming ribs.

The loading unit 50, which is shown more clearly in FIG. 8, comprises a thin plate-like spring blade 51 having a tip 51*a* which is preferably slightly rounded. The spring blade 51 extends as a unified construction across substantially the entire width of the web and the wires 10,20. In the area of the tip 51*a* of the spring blade 51, there may be a perforation or aperture penetrable or passable by water. The spring blade 51 loads and drags against the inner face of the wire 10/20 by means of its wide side, and the spring blade 51 is attached, from its edge opposite to the wide sides, between fastening parts 52*a* and 52*b* in connection with a frame part 53 of the loading device 50.

It is an important feature of the construction and material of the spring blade 51 that the blade 51 operates as a plate spring whereby a dragging and loading pressure against the wire 10,20 is produced by loading the blade from one edge so that it is curved during operation. The blade 51 is stationary, and preferably it drags "with the fur" against the inner face of the wire 10,20 that it loads. Thus, in the running direction of the wires 10,20, the blade 51 fastening parts 52*a*,52*b* are placed before the dragging and loading area A of the spring blade 51 and the spring blade 51 extends rearward. The loading units 50 are attached to the frame part 30 by means of a groove-projection fitting 56 so that the loading units 50 can be replaced rapidly by new ones when their spring blades are worn. It is understood by those skilled in the art that other suitable fastening/attachment means for removably attaching the loading units 50 to the frame part 30 are also within the scope of the invention.

In FIG. 8, the separation and bag-formation (crushing) of the wires is also sketched, which phenomenon was described above initially as occurring in the prior art between the forming ribs 44. In the prior art, by the effect of negative pressure, the upper wire 10 ran along the path 10C indicated by the dashed line whereas the lower wire ran along the straight path 20D such that a bag C was formed between the wires, i.e., the path of the wires diverged. In this "bag", the structure of the web W was broken and the formation of the web W was deteriorated by the effect of the phenomenon known as crushing. The formation of the "bag" was also facilitated by the absence of a support between the ribs 44.

FIG. 8 also shows a preferred location and mode of effect of the spring blades 51 in the loading device 50 in accordance with the invention. The location of the dragging area A of the tip 51*a* of the spring blades 51 is in the middle area of the gaps between the forming ribs 44, the length of the gaps in the machine direction being denoted by $L_2$. In such a case, the spring blades 51 load the wires 10,20 against each other so that the separation and bag-formation of the wires 10,20, which was described above initially, cannot take place, because the spring blades 51 force the lower wire 20 to follow the upper wire 10 tightly while curving the wire gently. The magnitude of the curving angle depends on the loading force of the spring blades 51. In the dragging area A of the spring blades 51, on the lower face of the lower wire 20, there is a thin lubricating water film, which reduces the wear of the wire 20.

The width of the forming ribs 44 in the machine direction is denoted by L, and the gap between them by $L_2$. The dimensions of the width between forming ribs 44 and the size of the gap are selected preferably in the ranges of $L_1$, from about 20 mm to about 70 mm and $L_2$ from about 20 mm to about 100 mm, and the ratio $L_1/L_2$ is selected preferably in the range of from about 0.2 to about 0.8.

In the arrangement of the loading unit 50, it is advantageous that the spring blade 51 is placed "with the fur" in relation to the running direction of the wires 10,20, i.e., so that the blade attaching point is upstream of the blade tip with respect to the motion of the fabrics/press wires and the web. The water that is drained out of the web W through the wire 10,20 acts as a lubricant in the dragging area A of the spring blade 51. If necessary, the loading unit 50 may also be provided with lubricant supply means such as water supply means, which lubricate the dragging area A of the blade 51, for example, during starting of the paper machine and during other disturbances in the operation.

In FIG. 8, the linear load of the loading force of the loading unit 50 is adjustable by means of the loading of a loading hose 54 through a rib 55 coupled thereto. An adjustable pressure P is applied to the rib 55 so as to determine the dragging force applied by the spring blade 51 to the wire 20. The transverse profile of the loading force can be arranged adjustable by means of various arrangements, which come out in more detail, e.g., from Finnish Patent No. 87,588 (corresponding to U.S. Pat. No. 5,211,814). As discussed above, the spring blade 51 of the loading unit is made of reversibly flexible plate spring material. It is also preferable that the ratio of the length L of the spring blade 51 to the thickness S of the plate material of the spring blade 51 should be in a certain range. The ratio L/S is preferably selected in a range from about 10 to about 1000, i.e., such that the spring blade follows variations in the thickness of the fiber layer or web. The optimal applications are typically in the range of L/S from about 300 to about 500. The value of the ratio L/S also depends on the material of the spring blade. As the blade material, preferably a wear-resistant spring steel is used, for example stainless steel. Also it may be possible to use some plastic materials and composite and/or sandwich constructions. The spring blade 51 does not necessarily have to be of equal thickness and/or of the same material and/or of the same construction over its entire length and/or across its entire width, i.e., its properties such as the thickness, composition, etc., can be varied across the width. Another advantageous feature in the construction of the spring blade 51 is its spring action, so that, by loading the blade 51 by means of the loading means, the shape of the blade plate can be deflected in the machine direction with a relatively large curve radius $R_0$ which is from about 200 mm to about 1000 mm; in accordance with the conditions of elasticity and with the loads, and a wide dragging area A against the wire 10,20 can be obtained. Thus, the material of the spring blade 51 must be suitable in respect of its spring properties, and permanent deformations must not arise in it. Generally, the spring blade 51 is dimensioned and the spring properties of its material are selected so that the spring constant of the bending of the blade per meter of width is in the range of from about 1.6 kN/mm to about 0.02 kN/mm, preferably in the range of from about 0.1 kN/mm to about 0.03 kN/mm. In particular in composite constructions, the spring constant may be different in the machine direction as compared with the cross direction. If necessary, the area of the spring blade 51 that will load and rub against the wire 10,20 can be provided with a wear piece or with a wear-resistant coating, for example with a ceramic layer. Additional details of the spring blade can be found in U.S. Pat. No. 5,211,814.

The examples provided above are not meant to be exclusive. Many other variations of the present invention would be obvious to those skilled in the art, and are contemplated to be within the scope of the appended claims.

We claim:

1. A web former in a paper machine including a first, upper wire and a second, lower wire forming a twin-wire zone and web forming and dewatering members, comprising:

guide means for guiding the first wire in a loop, said guide means comprising a first forming roll arranged inside the loop of the first wire at a beginning of the twin-wire zone, a forming rib unit arranged in an initial portion of the twin-wire zone inside a loop of the second wire, said forming rib unit including transverse forming ribs which extend across substantially an entire width of the second wire and are placed at a distance from one another in a running direction of the second wire such that gaps are defined between adjacent ones of said transverse forming ribs, and a loading unit arranged inside the loop of the first wire at least partially in opposed relationship to said forming rib unit, the loop of the first wire being situated above the loop of the second wire such that said loading unit is arranged above said forming rib unit, said loading unit including spring blades arranged to engage the first wire, each of said spring blades having a dragging and loading area situated substantially in a middle area of a respective one of the gaps between said transverse forming ribs and comprising a plate arranged to drag against an inner face of the first wire to produce a loading pressure, each of said spring blades being made of a flexible plate material and for each of said spring blades, the ratio of a length L in the machine direction to a thickness S of the flexible plate material is in a range from about 10 to about 1000, loading means for loading said spring blades against the first wire, a frame part associated with said loading unit, and attachment means connected to said frame part for attaching each of said spring blades from outside its dragging and loading area to said frame part.

2. The former of claim 1, further comprising a guide roll arranged inside the loop of the second wire to guide the second wire to converge with the first wire and thereby define a forming gap between said first forming roll and said guide roll, and a second forming roll arranged in the twin-wire zone after said forming rib unit and said loading unit, said second forming roll being arranged to curve the twin-wire zone downward.

3. The former of claim 2, wherein the second wire is guided by said guide roll to engage a web situated between the first and second wires at a location at which the second wire is substantially tangential to said first forming roll, the twin-wire zone being guided in an upwardly inclined run from said location to said forming rib unit and said loading unit, said second forming roll being arranged in the loop of the second wire.

4. The former of claim 1, wherein said forming rib unit comprises a forming shoe having a curved ribbed deck including said transverse forming ribs, further comprising a suction-deflector member for drawing water from the twin-wire zone arranged in the loop of the first wire and having a bottom region, said loading unit being connected to said bottom region of said suction-deflector member.

5. The former of claim 1, further comprising a guide roll arranged inside the loop of the second wire to guide the second wire to converge with the first wire and thereby define a forming gap between said first forming roll and said guide roll, and suction-deflector means for drawing water from the twin-wire zone arranged in the loop of the first wire above said transverse forming ribs.

6. The former of claim 1, wherein said loading unit is arranged substantially immediately after the first forming roll.

7. The former of claim 1, wherein the first wire is guided to define a substantially straight single-wire zone preceding the twin-wire zone, a portion of the web dewatering and formation members operating on the web in the single-wire zone.

8. The former of claim 7, wherein the initial portion of the twin-wire zone is upwardly inclined, further comprising a suction-deflector member for drawing water from the twin-wire zone arranged in the loop of the first wire and having a bottom region, said loading unit being connected to said bottom region of said suction-deflector member, and a second forming roll arranged in the loop of the second wire after said forming rib unit, said forming roll being arranged to curve the twin-wire zone downward.

9. The former of claim 7, wherein the running direction of the twin-wire zone between the first wire and the second wire is substantially horizontal.

10. The former of claim 1, wherein each of said spring blades is arranged such that the dragging area of said spring blade encompasses a midpoint of the respective gap.

11. The former of claim 1, wherein for each of said spring blades, the ratio of a length L in the machine direction to a thickness S of the flexible plate material is in a range from about 300 to about 500.

12. The former of claim 1, wherein said spring blades are arranged such that each of said spring blades is attached at an attaching point upstream of a tip of said spring blade with respect to the running direction of the first wire.

13. The former of claim 1, wherein the distribution of linear load in the dragging area of said spring blades in the cross-machine direction is adjustable.

14. The former of claim 1, wherein said transverse forming ribs are spaced apart by a distance between 20 mm and 100 mm and each of said spring blades has a tip arranged to engage the first wire at a location midway between a respective pair of adjacent ones of said transverse forming ribs such that at least a portion of said tip is a distance of between 10 mm and 50 mm, respectively, from each of said transverse forming ribs in the respective pair of adjacent ones of said transverse forming ribs.

15. A twin-wire forming zone for a web former in a paper machine, comprising a first, upper wire, first wire guiding means for guiding said first wire in a loop, a second, lower wire, second wire guiding means for guiding said second wire in a loop, said first wire guiding means comprising a first forming roll arranged inside a loop of said first wire to guide said first wire toward said second wire such that said first and second wires form the twin-wire zone about said first forming roll, a forming rib unit arranged in an initial portion of the twin-wire zone inside a loop of said second wire, said forming rib unit including transverse forming ribs which extend across substantially an entire width of said second wire and are placed at a distance from one another in a running direction of said second wire such that gaps are defined between adjacent ones of said transverse forming ribs, and a loading unit arranged inside a loop of said first wire at least partially in opposed relationship to said forming rib unit, the loop of said first wire being situated above the loop of said second wire such that said loading unit is arranged above said forming rib unit, said loading unit including spring blades arranged to engage said first wire, each of said spring blades comprising a plate arranged to drag against an inner face of said first wire to produce a loading pressure and having a dragging and loading area situated substantially in a middle area of a respective one of the gaps between said transverse forming ribs, each of said spring blades being made of a flexible plate material and for each of said spring blades, the ratio of a length L in the machine direction to a thickness S of the flexible plate material is in a range from about 10 to about 1000, loading means for loading said spring blades against the first wire, a frame part associated with said loading unit, and attachment means for attaching each of said spring blades from outside its dragging area to said frame part.

16. The twin-wire zone of claim 15, further comprising a second forming roll arranged after said forming rib unit and said loading unit, said second forming roll being arranged to curve the twin-wire zone downward.

17. The twin-wire zone of claim 15, wherein said forming rib unit comprises a forming shoe having a curved ribbed deck including said transverse forming ribs, further comprising a suction-deflector member for drawing water from the twin-wire zone arranged in the loop of the first wire and having a bottom region, said loading unit being connected to said bottom region of said suction-deflector member.

18. The twin-wire zone of claim 15, wherein said spring blades are arranged such that each of said spring blades is attached at an attaching point upstream of a tip of said spring blade with respect to the running direction of said first wire.

19. The twin-wire zone of claim 15, wherein said loading unit is arranged substantially immediately after the first forming roll.

20. The twin-wire zone of claim 15, wherein each of said spring blades is arranged such that the dragging area of said spring blade encompasses a midpoint of the respective gap.

21. A web former in a paper machine including a first wire and a second wire forming a twin-wire zone and web forming and dewatering members, comprising:

forming gap formation means arranged at an initial end of the twin-wire zone, said forming gap formation means comprising first and second rolls arranged to guide the first and second wires, respectively, to converge and define a forming gap, said first roll being a first forming roll arranged in a loop of the first wire, the former being a vertical former whereby the twin-wire zone runs substantially vertically upward;

a forming rib unit arranged in an initial portion of the twin-wire zone inside a loop of the second wire, said forming rib unit including transverse forming ribs which extend across substantially an entire width of the second wire and are placed at a distance from one another in a running direction of the second wire such that gaps are defined between adjacent ones of said transverse forming ribs, said transverse forming ribs in said forming rib unit being structured and arranged to provide said forming rib unit with a radius of curvature such that the twin-wire zone curves in a run over said forming rib unit;

a loading unit arranged inside the loop of the first wire at least partially in opposed relationship to said forming rib unit and such that said loading unit has a curvature corresponding to the curvature of said forming rib unit, said loading unit being arranged immediately adjacent to said first forming roll and including spring blades arranged to engage the first wire, each of said spring blades having a dragging and loading area situated substantially in a middle area of a respective one of the gaps between said transverse forming ribs and comprising a plate arranged to drag against an inner face of the first wire to produce a loading pressure, each of side spring blades being made of a flexible plate material and for each of said spring blades, the ratio of a length L in the machine direction to a thickness S of the flexible plate material is in a range from about 10 to about 1000, loading means for loading said spring blades against the first wire, a frame part associated with said loading unit, and attachment means connected to said frame part for attaching each of said spring blades from outside its dragging and loading area to said frame part:

a second forming roll arranged after said transverse forming ribs and said loading unit; and separation means for separating the first wire from the web after said second forming roll such that the web is carried only on the second wire.

* * * * *